US011679472B2

(12) United States Patent
Chen et al.

(10) Patent No.: US 11,679,472 B2
(45) Date of Patent: Jun. 20, 2023

(54) METHOD FOR CMP PAD CONDITIONING

(71) Applicant: TAIWAN SEMICONDUCTOR MANUFACTURING COMPANY, LTD., Hsinchu (TW)

(72) Inventors: ChunHung Chen, Youngjing (TW); Sheng-Chen Wang, Taichung (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 0 days.

(21) Appl. No.: 16/874,403

(22) Filed: May 14, 2020

(65) Prior Publication Data

US 2020/0269384 A1 Aug. 27, 2020

Related U.S. Application Data

(62) Division of application No. 15/489,866, filed on Apr. 18, 2017, now Pat. No. 10,675,732.

(51) Int. Cl.

| | |
|---|---|
| ***B24B 53/017*** | (2012.01) |
| ***B24B 49/12*** | (2006.01) |
| ***B24B 49/16*** | (2006.01) |
| ***B24B 49/18*** | (2006.01) |

(52) U.S. Cl.

CPC ..... *B24B 53/017* (2013.01); *B24B 49/12* (2013.01); *B24B 49/16* (2013.01); *B24B 49/18* (2013.01)

(58) Field of Classification Search

CPC ..... B24B 53/017; B24B 53/005; B24B 53/02; B24B 53/00; B24B 53/12; B24B 49/12; B24B 49/16; B24B 49/18; B24B 49/00; B24B 49/186; B24B 37/005; B24B 37/105; B24B 37/34; B24B 37/013; B24B 37/02; B24B 37/26; B24B 37/04; B24B 37/042; B24B 37/046; B24B 37/07; B24B 37/10; B24B 37/11

USPC ..... 451/6

See application file for complete search history.

(56) References Cited

U.S. PATENT DOCUMENTS

| | | | | |
|---|---|---|---|---|
| 5,708,506 | A | 1/1998 | Birang | |
| 6,494,765 | B2 | 12/2002 | Gitis | |
| 6,722,948 | B1 | 4/2004 | Berman | |
| 7,070,479 | B2 * | 7/2006 | Faustmann | B24B 49/16 451/21 |
| 8,221,193 | B2 | 7/2012 | Chang | |
| 8,517,796 | B2 * | 8/2013 | Shinozaki | B24B 53/017 451/5 |
| 9,108,292 | B2 | 8/2015 | Shimano | |

(Continued)

FOREIGN PATENT DOCUMENTS

KR 20150047180 A * 5/2015

*Primary Examiner* — Joel D Crandall
*Assistant Examiner* — Michael A Gump
(74) *Attorney, Agent, or Firm* — Hauptman Ham, LLP

(57) ABSTRACT

A method of conditioning a polishing pad includes positioning a conditioning head to bring a conditioning pad into contact with a polishing surface of a polishing pad. The method further includes generating a first pressure signal using a first pressure sensor based on a force being applied to the polishing surface by the conditioning pad. The method further includes generating a surface condition signal using an optical scanner. The method further includes adjusting the positioning of the conditioning pad in response to at least one of the first pressure signal or the surface condition signal.

20 Claims, 14 Drawing Sheets

(56) References Cited

U.S. PATENT DOCUMENTS

| | | | | |
|---|---|---|---|---|
| 9,138,860 | B2 * | 9/2015 | Dhandapani | B24B 37/042 |
| 9,685,342 | B2 | 6/2017 | Kramer | |
| 9,808,908 | B2 | 11/2017 | Shinozaki | |
| 9,962,804 | B2 | 5/2018 | Shinozaki | |
| 10,016,871 | B2 | 7/2018 | Shinozaki | |
| 2001/0012749 | A1 | 8/2001 | Oguri | |
| 2004/0132309 | A1 | 7/2004 | Sakuma | |
| 2005/0090185 | A1 | 4/2005 | Fujishima | |
| 2013/0122783 | A1 * | 5/2013 | Menk | B24B 37/042 451/11 |
| 2014/0262027 | A1 | 9/2014 | Matsuo | |
| 2015/0056891 | A1 | 2/2015 | Matsuo | |
| 2015/0170978 | A1 | 6/2015 | Chen | |
| 2018/0345454 | A1 | 12/2018 | Chen | |
| 2019/0160625 | A1 | 5/2019 | Hu | |

* cited by examiner

100

METHOD FOR CMP PAD CONDITIONING

RELATED APPLICATIONS

This application is a divisional of Ser. No. 15/489,866, filed Apr. 18, 2017, the contents of which are hereby incorporated by reference in their entirety.

BACKGROUND

Chemical mechanical polishing (CMP) processes are widely used in semiconductor manufacturing processes for removing material from a surface of a semiconductor wafer and producing a planarized surface. The CMP processes use a combined action of a polishing pad and a polishing slurry for polishing the semiconductor wafer. A surface roughness of the polishing pad, a relative movement of the semiconductor wafer and the polishing pad, a pressure exerted on the semiconductor wafer by the polishing pad, and a slurry composition and volume are some factors that will affect the results achieved by the CMP process.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
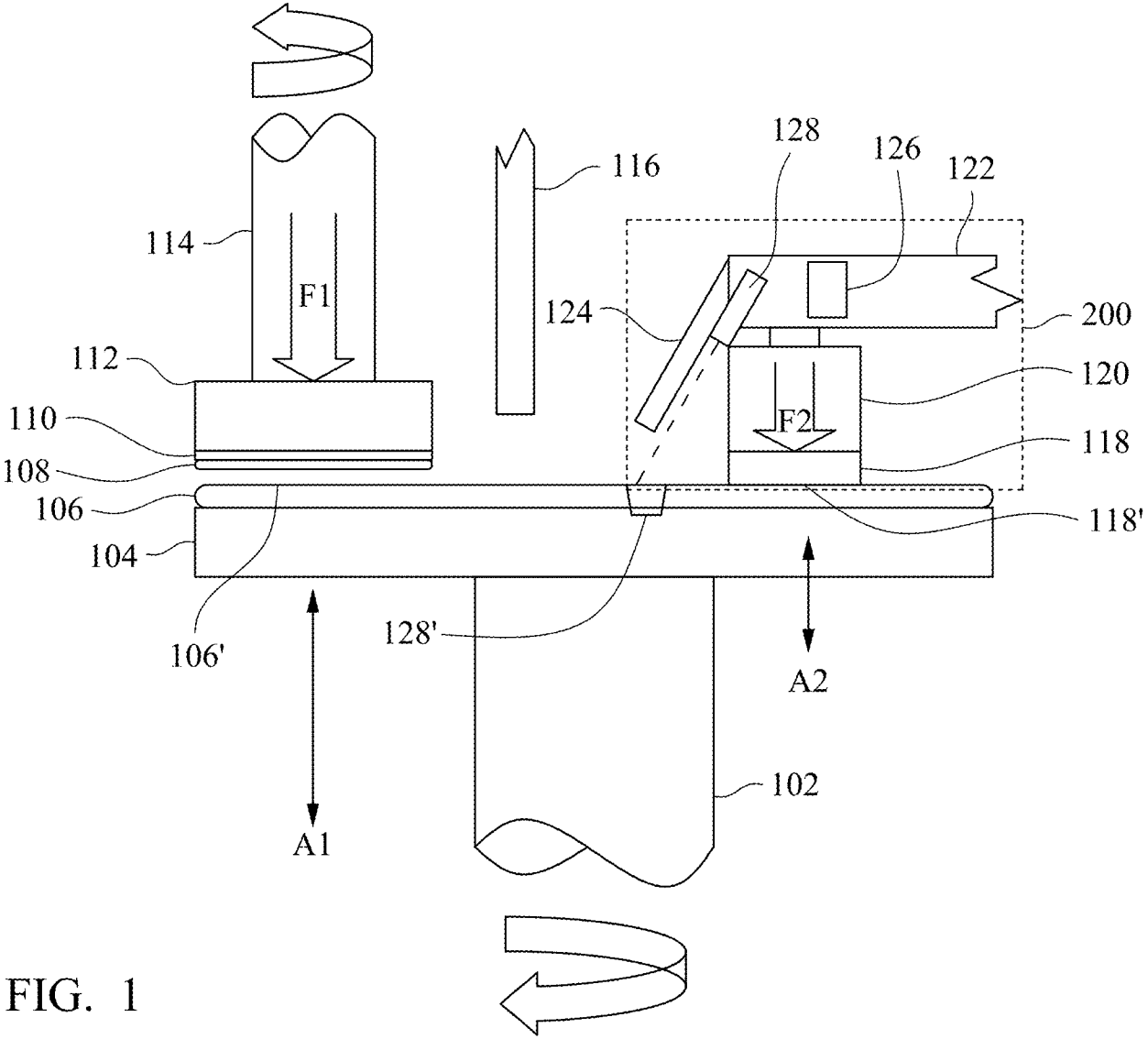
FIG. 1 is a side view of a CMP apparatus, in accordance with some embodiments of the present disclosure.

The following disclosure provides many different embodiments, or examples, for implementing different features of the provided subject matter. Specific examples of components, materials, values, steps, operations, materials, arrangements, or the like, are described below to simplify the present disclosure. These are, of course, merely examples and are not intended to be limiting. Other components, values, operations, materials, arrangements, or the like, are contemplated. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other specified orientations) and the spatially relative descriptors used herein may likewise be interpreted accordingly.

Chemical mechanical polishing (CMP) utilizes a rotating polishing pad contacting a wafer surface to remove material from an existing wafer topography. In addition to rotating the polishing pad, the wafer or substrate, in some embodiments, is held stationary. In some embodiments, the wafer or substrate is independently rotated to enhance the polishing process. During the polishing operation, a dispenser applies a volume of a polishing slurry to the polishing pad so that the polishing pad surface is permeated with the polishing slurry. The polishing slurry, in some embodiments, contains various components including submicron abrasives, etchants, or other chemicals appropriate to particular materials exposed during the polishing operation. The quality and uniformity of the polishing pad surface help achieve a uniform and repeatable removal rate and profile of the wafers. In order to maintain the desired polishing performance, the polishing pad surface is at least periodically subjected to one or more conditioning processes. In some embodiments, the polishing pad includes polyurethane or other suitable materials.

During the CMP process, the initial surface roughness of the polishing pad will be reduced as the polishing pad is worn down by friction between the polishing pad, the semiconductor wafer, and abrasives in the slurry, thereby reducing a rate at which material is removed from the surface of the semiconductor wafer. CMP processes, therefore, include a conditioning process in order to recover the surface roughness of the polishing pad. A CMP apparatus is therefore provided with pad conditioners for in-situ reconditioning that includes mechanically resurfacing the polishing pad and removing slurry or other material that has accumulated or been retained on the surface of the polishing pad to maintain or recover the surface roughness.

The conditioning process renews the polishing pad surface by removing accumulated abrasive particles and other debris from the polishing pad and restoring a predetermined degree of surface roughness (Ra) to the polishing pad. In at least some embodiments, the conditioning process utilizes a conditioning pad having a diamond grit surface that is applied to the surface of the rotating polishing pad. In some embodiments, the conditioning process also includes application of a flushing solution for improving removal of the debris released from the polishing pad by operation of the conditioning pad. In some embodiments, the conditioning process takes place concurrently with the wafer polishing operation. In some embodiments, the conditioning process is conducted as a separate operation either before or after the wafer polishing operation.

Because, in some embodiments, the polishing pad is larger than the conditioning pad, the conditioning pad is mounted on a conditioning head that is, in turn, mounted on a support arm. The support arm allows the conditioning head to be supported and moved across the rotating surface of the polishing pad. The linear and/or arcuate movements provided by the conditioning mechanism allow the smaller conditioning pad to condition the entire surface of the larger polishing pad. In some other approaches, the conditioning process includes a predetermined number of timed scans and/or sweeps across the surface of the polishing pad that provide a sufficient level of conditioning. Achieving uniform conditioning of the entire polishing pad surface becomes more challenging as the polishing pad sizes are increased in order to accommodate increasing semiconductor wafer sizes.

Increasing the size of the conditioning pad to address a larger polishing pad introduces difficulty in manufacturing a diamond grit surface of the conditioning pad at larger dimensions. In particular, if the conditioning surface of the conditioning pad is not sufficiently planar, the embedded abrasive particles, e.g., diamond grit, are removed from the surface of the conditioning pad, thereby contaminating and/or damaging the polishing pad surface and increasing the risk of damage to the surface of wafers during subsequent polishing operations.

At least one pressure sensor and an associated controller are used for enhancing control of the manner in which the conditioning pad is applied to the surface of the polishing pad during a conditioning process. The conditioning process takes place in-situ, i.e., without removing the polishing pad from the CMP apparatus, or offline on a mechanism not being used for CMP processes. The conditioning process takes place either concurrently with the CMP processing, i.e., while the wafer polishing operation is being conducted on another portion of the polishing pad, or before or after conducting the wafer polishing operation. In some embodiments, the at least one pressure sensor is used with various sizes and configurations of polishing pads as well as various sizes and numbers of conditioning pads. In some instances, the polishing pad is conditioned by applying, either simultaneously or sequentially, multiple conditioning pads to a polishing pad. In some embodiments, multiple conditioning pads used to condition a polishing pad are controlled by separate controllers, while in other embodiments multiple conditioning pads are controlled by a single controller.

FIG. 1 is a side view of a CMP apparatus 100 in accordance with some embodiments. CMP apparatus 100 includes a rotatable shaft 102 supporting a platen 104 with a polishing pad 106 fixedly secured to the platen. Platen 104 rotates in at least a first direction of rotation about a first axis A1 at one or more rotational speeds suitable for CMP operations. A wafer carrier 112 supports a wafer 108 that, in some embodiments, is provided with a backing film 110. Wafer carrier 112 positions wafer 108 on a polishing surface 106' of polishing pad 106 at a polishing location.

Wafer carrier 112 is supported by a movable and rotatable shaft 114 through which a force F1 is applied along a first axis A1 to press an exposed wafer surface against polishing surface 106' of polishing pad 106. In some embodiments, first axis A1 is perpendicular to polishing surface 106'. Wafer carrier 112 rotates in at least a second direction at one or more rotational speeds suitable for CMP operations while the exposed wafer surface is in contact with rotating polishing pad 106. During CMP operations, a slurry dispenser 116 dispenses a flow of slurry onto one or more dispense locations on the surface of polishing pad 106 to permeate polishing surface 106'.

CMP apparatus 100 includes a conditioning apparatus 200 including a conditioning pad 118 supported on a conditioning head 120 that is fixed to a support arm 122. In some embodiments, conditioning pad 118 rotates about a second axis A2. In some embodiments, first axis A1 and second axis A2 are both perpendicular to polishing surface 106' of the polishing pad 106 and offset in a direction parallel to the polishing surface 106' from each other. Movement of support arm 122 brings conditioning pad 118 into contact with polishing surface 106' of polishing pad 106 with an applied force F2. In some embodiments, applied force F2 is applied along second axis A2. In some embodiments, additional positioning mechanisms are provided within conditioning head 120 for adjusting the position of the conditioning pad 118 relative to support arm 122. In some embodiments, the additional positioning mechanisms include a mechanical, electromechanical, hydraulic, and/or pneumatic actuating assembly.

In some embodiments, support arm 122 also provides axial and/or arcuate movement of conditioning head 120 in a horizontal plane above and generally parallel to polishing surface 106' of polishing pad 106 along a path from a first horizontal position to a second horizontal position. In some embodiments, movement of support arm 122 produces horizontal axial and/or arcuate movement of the conditioning pad whereby a smaller conditioning pad 118 is able to condition the entire polishing surface 106' of a larger polishing pad 106. In some embodiments, an exposed conditioning surface 118' of conditioning pad 118 includes a grit material, e.g., diamond grit, embedded in a polymer matrix.

In some embodiments, conditioning apparatus 200 includes a flush solution dispenser 124 for assisting with debris removal from the polishing pad surface during a conditioning process. In some embodiments, conditioning apparatus 200 includes a surface condition scanner 128, e.g., an optical scanner, for evaluating a surface condition, e.g., roughness, of a scanned area 128' on polishing surface 106' of polishing pad 106 and generating a corresponding surface condition signal reflecting the detected surface condition. In some embodiments, surface condition scanner 129 is separated from conditioning apparatus 200. In some embodiments, conditioning apparatus 200 includes a pressure monitor 126 for monitoring pressure data from the at least one pressure sensor provided within conditioning apparatus 200 and transmitting the pressure data to the controller.

In some embodiments, conditioning surface 118' includes other suitable materials such as scouring materials or bristles, such as a brush. In some embodiments, the movement of conditioning pad 118 relative to the polishing pad 106 results only from a rotation of polishing pad 106 and movement of support arm 122. In some embodiments, one or more mechanisms are usable to urge conditioning surface 118' of conditioning pad 118 against polishing surface 106' and to provide the rotation and/or horizontal movement (translation) of conditioning pad 118 across polishing pad 106.

Figure 2:
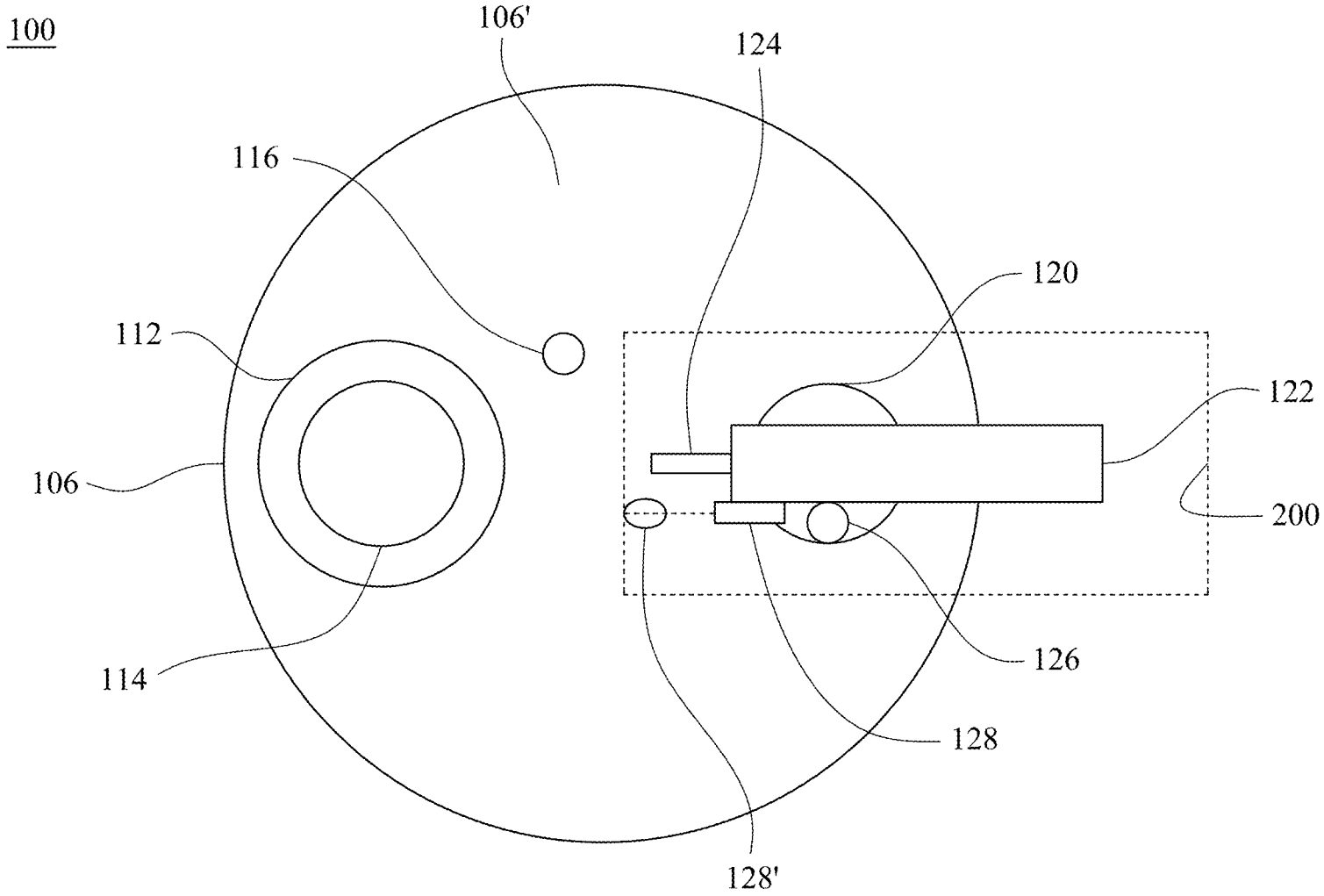
FIG. 2 is a plan view of a CMP apparatus, in accordance with some embodiments of the present disclosure.

FIG. 2 is a plan view of CMP apparatus 100 in accordance with some embodiments. CMP apparatus 100 includes polishing surface 106' of polishing pad 106, the moveable and rotatable shaft 114 supporting wafer carrier 112 and slurry dispenser 116. As shown in FIG. 2, conditioning apparatus 200 includes support arm 122, conditioning head 120, flush solution dispenser 124, pressure monitor 126, and polishing pad surface condition scanner 128.

Figure 3:
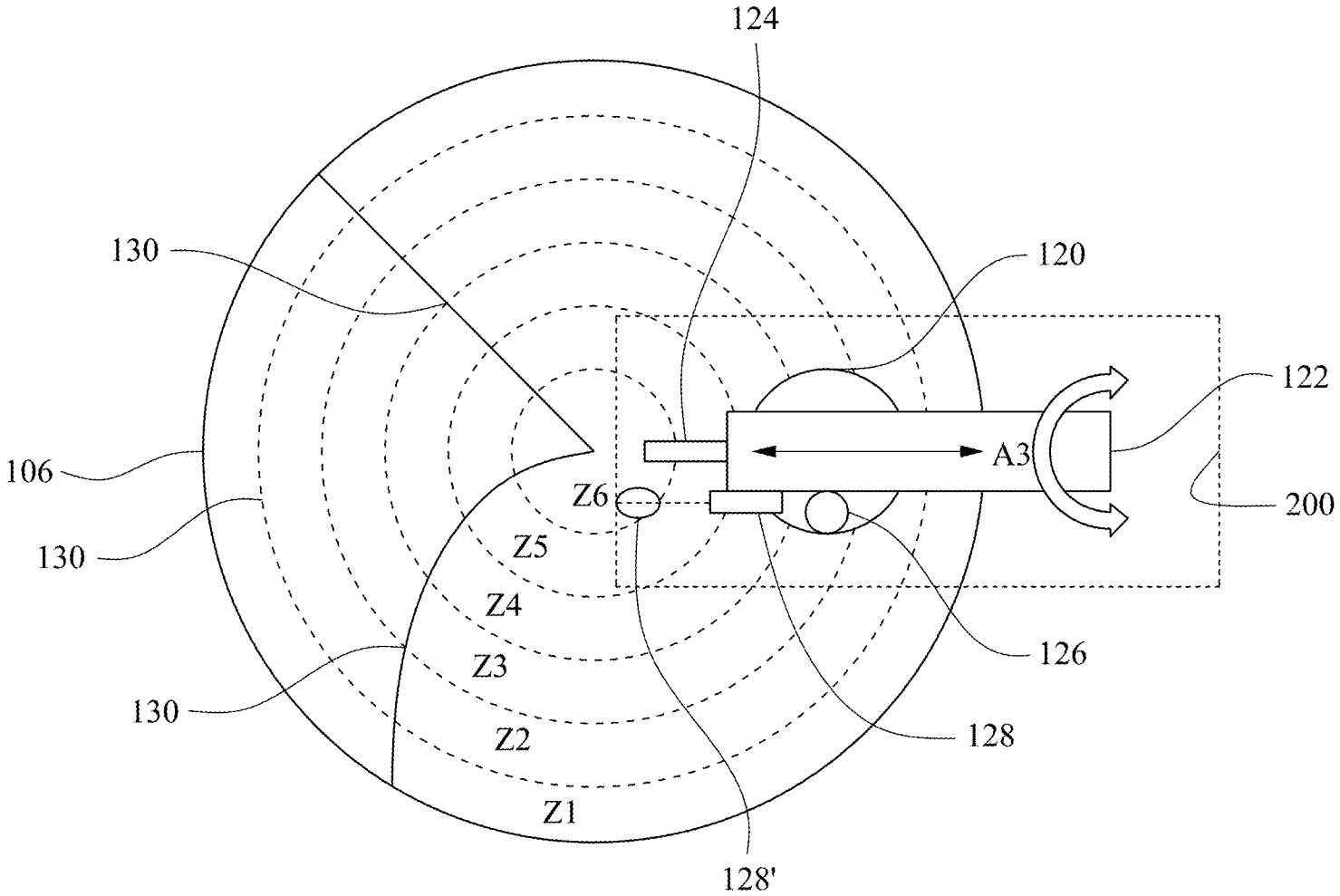
FIG. 3 is a plan view of portions of a CMP apparatus, in accordance with some embodiments of the present disclosure.

FIG. 3 is a plan view of CMP apparatus 100 in accordance with some embodiments. As illustrated in FIG. 3, conditioning apparatus 200 is configured to move conditioning head 120 relative to polishing surface 106' of polishing pad 106. In some embodiments, movement of conditioning head 120 is achieved through extension and retraction of support arm 122 between a first position and a second position along a major longitudinal axis A3 of support arm 122, i.e., axial motion. In some embodiments, the motion includes a rotational motion about at least one pivot point provided in conjunction with support arm 122, i.e., arcuate motion. In some embodiments, the axial motion is directed along a radius, chord, or chord segment of polishing pad 106. In some embodiments, the arcuate motion is initiated about a pivot point provided in a terminal portion (not shown) of support arm 122 provided and/or about an intermediate pivot point (not shown) provided between adjacent segments (not shown) of support arm 122.

In some embodiments, polishing pad 106 includes at least one recessed area 130 in the form of a groove, channel, aperture, or other indentation (not shown) arranged across polishing pad 106 for monitoring the condition of polishing surface 106'. In some embodiments, a plurality of recessed areas 130 is arranged in circular, arcuate, radial and/or other suitable (not shown) patterns across polishing pad 106. In addition to the arrangement of recessed areas 130, some embodiments include recessed areas 130 of varying width, depth, and/or orientation to allow for differential surface evaluations using optical, contact or other suitable monitoring devices for evaluating the condition of the polishing surface 106'. In some embodiments, polishing surface 106' is partitioned into a plurality of zones Z1-Z6 that are subjected to various evaluations and/or conditioning processes as warranted for a given CMP process.

Conditioning apparatus 200 includes at least one pressure sensor (not shown) provided within conditioning head 120 for detecting and transmitting pressure data reflecting the conditions under which conditioning pad 118 is being applied to polishing surface 106' of polishing pad 106. In some embodiments, the at least one pressure sensor is located at one of the sensor positions available within conditioning head 120, for monitoring applied force F2. In some embodiments, when an arrangement, distribution, or array of a plurality of pressure sensors is utilized within conditioning head 120, the pressure sensors are able to monitor a distribution of applied force F2 across conditioning pad 118.

Based at least in part on this pressure data, a controller (not shown) is able to adjust the pressure applied to and/or the relative position of conditioning pad 118 and polishing pad 106. Based at least in part on this pressure data, the controller is able to determine that the conditioning process has been successfully completed, e.g., a surface condition signal is determined to be within a surface condition signal target range, and terminates the conditioning process accordingly. In some embodiments, the controller receives additional data from surface condition scanner 128 or another suitable sensor(s) (not shown) regarding other conditioning and/or polishing process factors including, for example, surface roughness (Ra) of the polishing pad, the relative condition of various polishing zones Z1-Z6, the power applied to maintain rotational speed of conditioning pad 118 in contact with polishing pad 106, and/or the status of recessed areas 130 provided on polishing pad 106. Controlling the conditioning process in light of the pressure data, as well as any additional data, helps to improve the conditioning process by maintaining the surface roughness of polishing pad 106 while helping to avoid unnecessary wear on polishing pad 106 and conditioning pad 118 resulting from overuse of a conditioning process.

A number of pressure sensors are suitable for use within conditioning head 120. In some embodiments, thin or extra-thin pressure sensors, e.g., pressure sensors having a thickness in a range from about 0.5 millimeters (mm) to about 5 mm are used. Thicker pressure sensors limit the placement options for the pressure sensor(s) within conditioning head 120 and/or structural modification of conditioning head 120 in order to allow a specific placement of the thicker pressure sensors, in some instances. A range of micro-electromechanical systems (MEMS) pressure sensors is suitable for inclusion in conditioning head 120 including, for example, both piezoresistive and/or capacitive pressure sensor designs.

Figure 4:
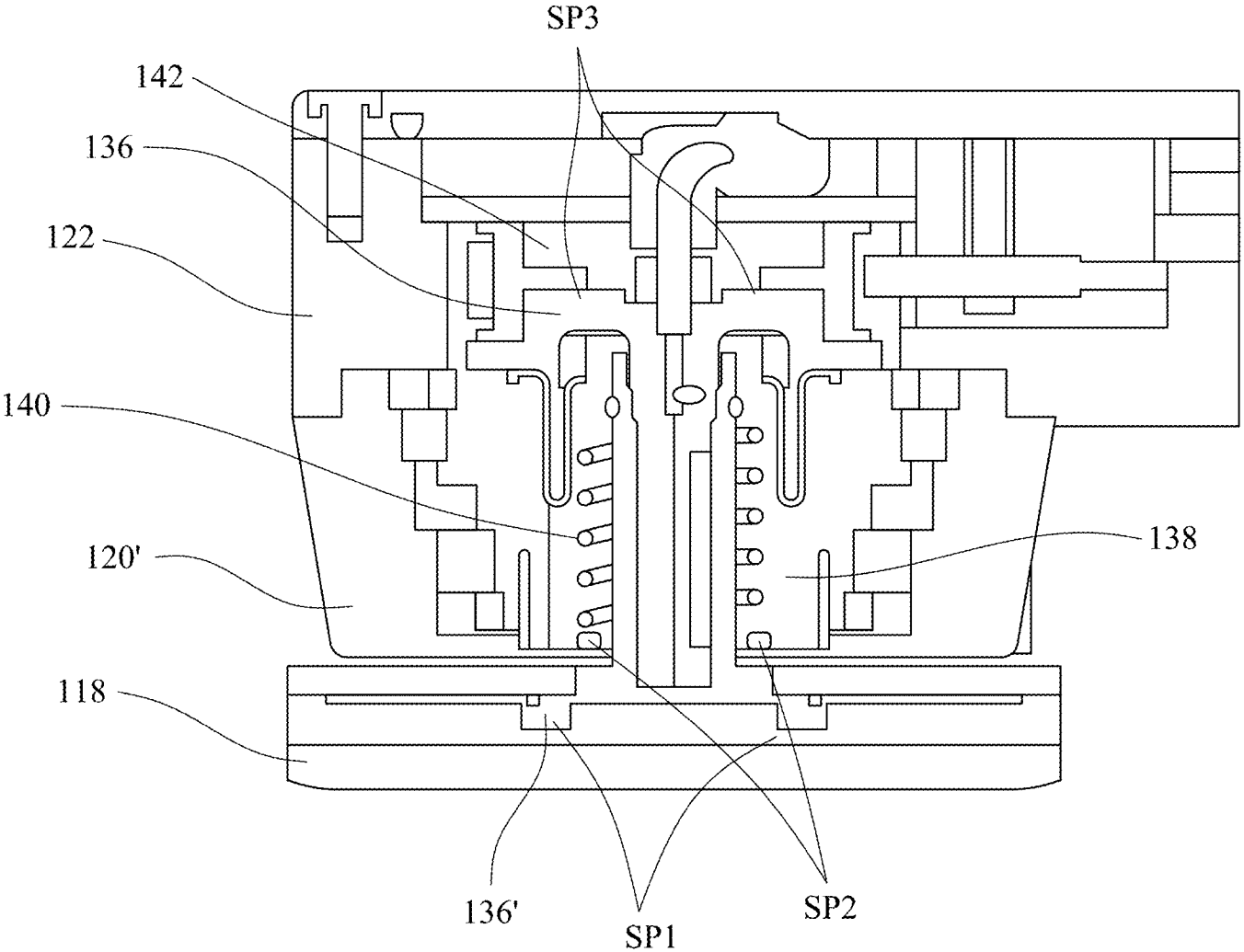
FIG. 4 is a cross-sectional view of a diaphragm-type pad conditioning head in accordance with some embodiments of the present disclosure.

A cross-sectional view of a diaphragm-type conditioning head 120' is in FIG. 4 in accordance with some embodiments. In some embodiments, the pressure sensor is placed at one of several different positions within conditioning head 120' selected from, for example, between a shaft 136', which attaches a disk holder 119 and moves reciprocatably relative to spindle 136, and disk holder 119, SP1; between an outer housing 138 and a biasing spring 140, SP2; and/or between spindle 136 and a drive pulley 142, SP3. Although sensor positions SP1-SP3 are indicated as specific locations, in some embodiments, the configuration of conditioner head 120' provides a plurality of SP1-SP3 sensor placement locations along a circular path. In some embodiments in which rotation of the installation position(s) relative to the rest of conditioning head 120' would interfere with a wired connection between the pressure sensor and the controller, e.g., SP1, a suitable wireless transmission protocol is utilized.

Figure 5:
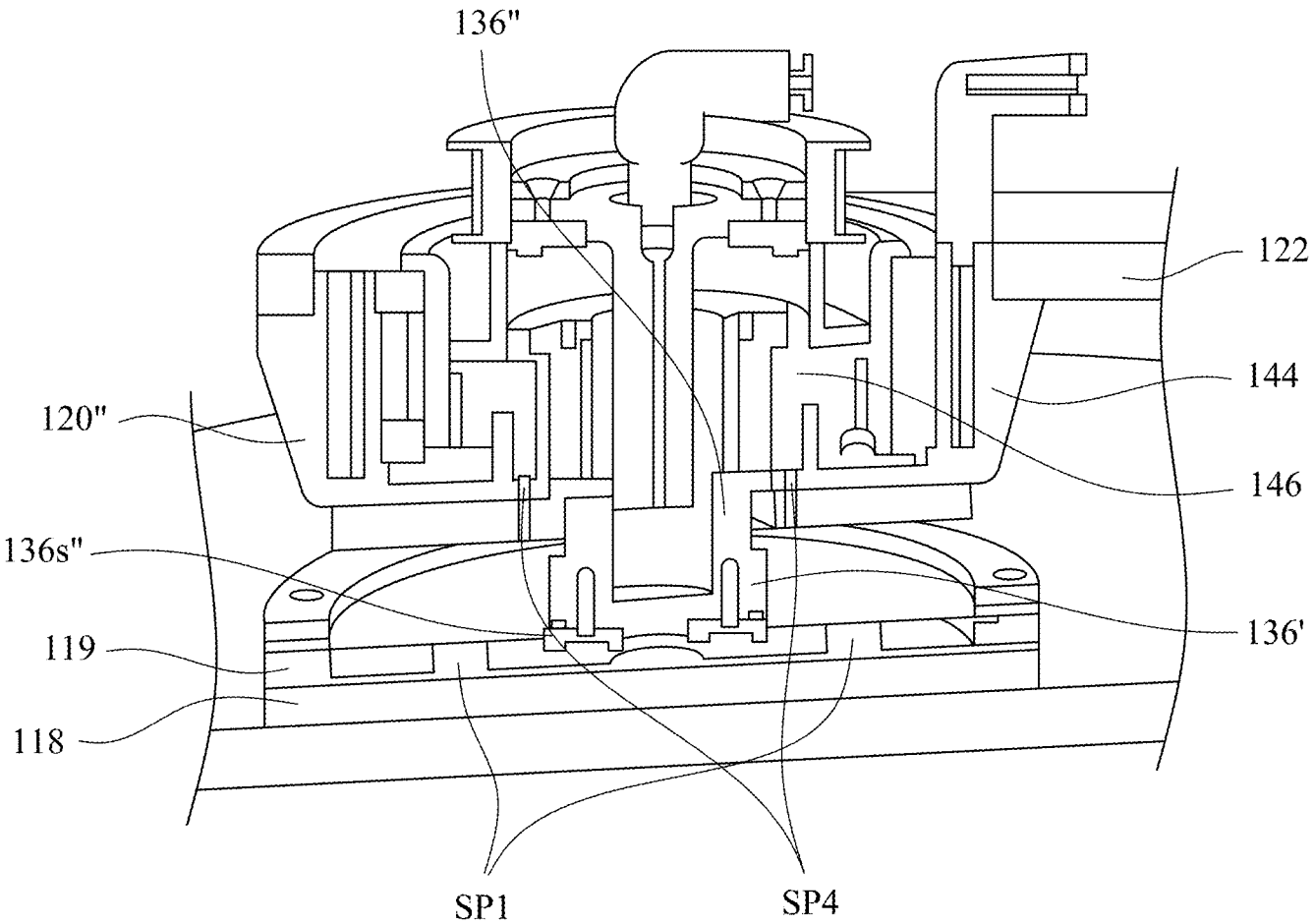
FIG. 5 is a perspective, cross-sectional view of a cylinder-type pad conditioning head in accordance with some embodiments of the present disclosure.

A cross-sectional view of a cylinder-type conditioning head 120" is in FIG. 5 in accordance with some embodiments. As with diaphragm-type conditioning head 120' in FIG. 4, the pressure sensor(s) is placed in different sensor positions within the conditioning head 120" selected from, for example, between disk holder 119 and shaft 136', SP1 and/or between an inner housing 136" and an outer housing 144 and a cylinder 146, SP4. Although sensor positions SP1 and SP4 are indicated as specific locations, in some embodiments, the configuration of the conditioner head 120" provides a plurality of SP1 or SP4 sensor placement locations along a circular path. In some embodiments in which rotation of the installation positions relative to the rest of the conditioning head would interfere with a wired connection between the pressure sensor and the controller, suitable wireless transmission protocols is utilized.

Figure 6B:
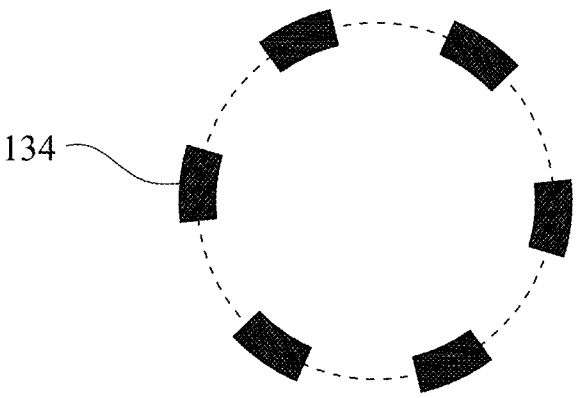
FIGS. 6A and 6B are plan views of pressure sensor(s) arrangements in accordance with some embodiments of the present disclosure.
Figure 6A:
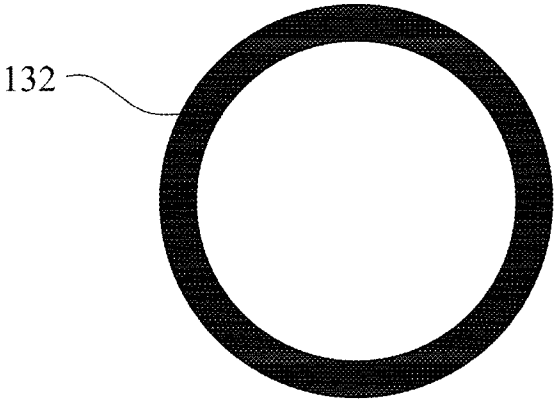

The pressure sensor(s) is configured as a single element pressure sensor 132, e.g., as a single circular sensor as shown in FIG. 6A, or as an array of discrete element pressure sensors 134, configured or arranged to form a pattern, e.g., the circular array of pressure sensors shown in FIG. 6B. In some embodiments, a radius of pressure sensor 132 or pressure sensor 134 ranges from about 10 mm to about 30 mm. A smaller radius reduces a uniformity of pressure feedback, in some instances. A greater radius occupies too much room to place pressure sensor 132 or pressure sensor 134 in the conditioning head, in some instances. In some embodiments where discrete element pressure sensors 134 are evenly arranges, each element pressure sensor 134 has a width ranging from about 0.1 mm to about 5 mm and has a length from about 1 mm to about 5 mm. One of ordinary skill in the art would understand that the sizing, number, and placement of pressure sensor(s) within the conditioning head 120, 120' or 120" is determined in part by sensor positions SP1-SP4 utilized and the internal dimensions of the conditioning head at the selected sensor position(s). Although a single pressure sensor will provide pressure data to the controller for improving the conditioning process, a distributed pressure sensor array, in some embodiments, provides a more complete characterization of the current status of the conditioning process.

When positioned adjacent conditioning pad 118, an array of independent pressure sensors 134 placed in sensor position SP1 each provide pressure data for evaluating operating factors including, for example, the uniformity of the contact between conditioning pad 118 and polishing pad 106. Pressure data indicating deviations from the desired contact uniformity or outside a predetermining threshold value is usable by the controller to modify the operating conditions to help improve conditioning performance and/or terminate the conditioning process for corrective action, thereby reducing the likelihood of damage to either conditioning pad 118 or polishing pad 106.

Figure 7B:
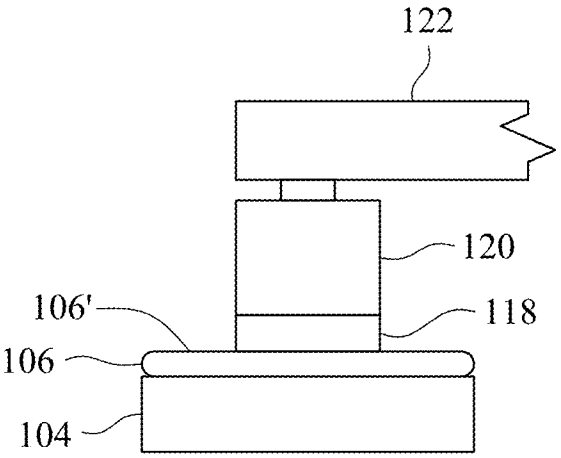
FIGS. 7A and 7B are perspective view of a CMP apparatus with a conditioning head in a disengaged position, FIG. 7A, and an engaged position, FIG. 7B, in accordance with some embodiments of the present disclosure.
Figure 7A:
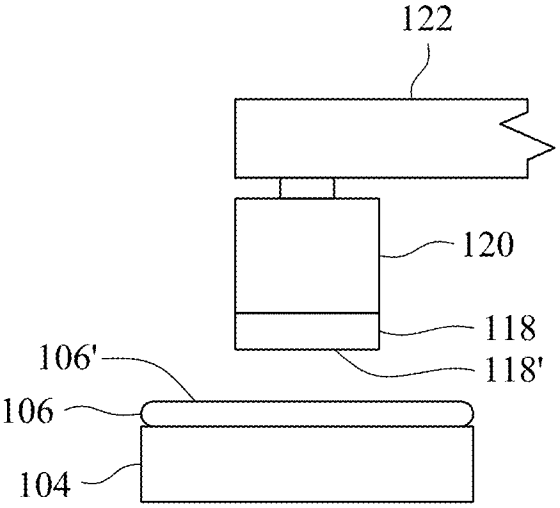
Figure 8:
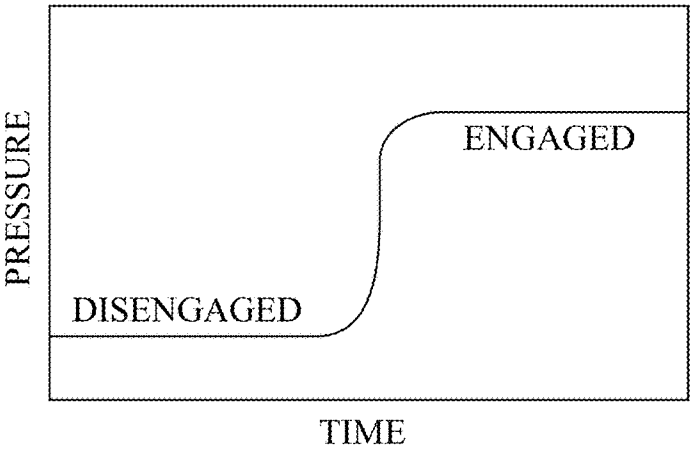
FIG. 8 is a chart illustrates pressure data generated by a pressure sensor within a conditioning head as the conditioning head is moved from a disengaged position to an engaged position in accordance with some embodiments of the present disclosure.

During some embodiments of a polishing pad conditioning process, the position of support arm 122 and/or supported conditioning head 120 is adjusted between a first position FIG. 7A, in which conditioning pad 118 is separated from polishing pad 106 (disengaged) and a second position (engaged) in which the (lower) conditioning surface 118' of conditioning pad 118 is brought into contact with an (upper) polishing surface 106' of polishing pad 106, FIG. 7B. In some embodiments, movement from the first position to the second position includes movement of conditioning head 120 along second axis A2. As conditioning pad 118 contacts polishing pad 106, pressure sensor(s) 132, 134 provided within conditioning head 120 (or conditioning head 120' in FIG. 4 or conditioning head 120" in FIG. 5) register increased pressure, as shown in FIG. 8, and transmit a corresponding pressure data signal to the controller. In some embodiments, the corresponding pressure data signal is successive during the polishing process and a continuous curve is generated accordingly. One of ordinary skill in the art would understand that, based on pressure data transmitted to the controller, the position of support arm 122 and/or conditioning head 120 is adjustable between a first engaged position and a second engaged position in order to maintain the condition of polishing pad 106 in a predetermined range.

This increased pressure is detected by the controller and indicates that the position of conditioning head 120 has been changed to the down or engaged position. The pressure sensor(s) and controller, therefore, help avoid use of an external up/down position sensor. The controller utilizes the transmitted pressure data signal for adjusting the position of support arm 122 along axis A2 and/or the pressure applied within the diaphragm (membrane) or the cylinder during the conditioning process in order to apply more uniform pressure between the conditioning and polishing pads and thereby improve the conditioning process.

Figure 9:
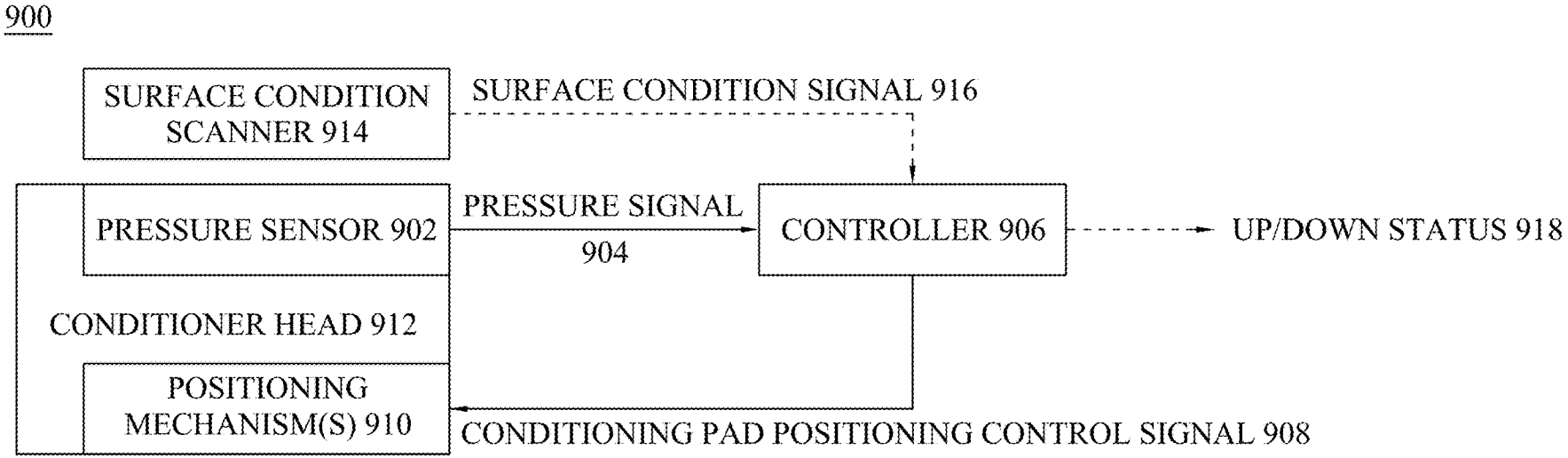
FIG. 9 is a schematic illustrating a control system in accordance with some embodiments of the present disclosure.

FIG. 9 shows a schematic of a control system 900 in accord with some embodiments in which a pressure sensor 902 within conditioner head 912 generates a pressure signal 904 and transmits the pressure signal to a controller 906 where the data signal is evaluated. In some embodiments, the result of the evaluation warrants an adjustment of the conditioning pad position for which a positioning control signal 908 is transmitted by controller 906 to one or more positioning mechanisms 910. In some embodiments, in response to positioning control signal 908, the positioning mechanism(s) 910 move conditioning pad 118 to an up/down status 918, e.g., a predetermined distance toward or away from polishing pad 106. In some embodiments, subsequent pressure signals 904 are used by controller 906 to refine the positioning of conditioning pad 108 during a pad conditioning process. In at least one embodiment where a surface condition scanner 914 is used, a surface condition signal 916 is generated and transmitted to controller 906 to help evaluate data signal collected. In some embodiments, controller 906 adjust a rotation of conditioning pad 118 responsive to at least pressure signal 904 or surface condition signal 916. For example, while pressure signal 904 is continuously transmitted to controller 906 during the pad conditioning process, up/down status 918 or the rotation of conditioning pad 118 is evaluated and adjusted for every 5 to 10 seconds.

In some embodiments, the controller adjusts at least an additional positioning mechanism provided within conditioning head 120 for adjusting the position of conditioning pad 118 relative to support arm 122. In some embodiments in which an additional positioning mechanism is available, the controller engages a mechanical, electromechanical, hydraulic, and/or pneumatic mechanism to adjust the position of conditioning pad 118 in response to data or signals corresponding to monitored pressure, conditioning, and/or polishing process factors. In some embodiments, hydraulic and/or pneumatic actuating assemblies include a source or reservoir of pressurized fluid connected to or in communication with a first pressure chamber provided within conditioning head 120 with which the controller selectively adjusts the fluid pressure within the first pressure chamber.

In other embodiments in which different portions or zones of the polishing pad are to receive different degrees of conditioning, the controller uses conditioning head positioning data, e.g., the axial position of support arm 122 along a radius of the polishing pad, in combination with the pressure sensor data to adjust the operation of conditioning head 120. In this manner, the conditioning apparatus is able to apply different pressure, rotational, and/or flush volume parameters to different zones of polishing pad 106.

In some embodiments, different operating parameters are used to improve the uniformity of the condition of polishing surface 106' of polishing pad 106, to improve the efficiency of the conditioning process by reducing over-conditioning, and/or to deliberately create zones having different predetermined surface properties. Similarly, in some embodiments the different operating parameters are utilized in multi-step conditioning processes to apply pre-treatment to polishing pad 106 to improve subsequent main conditioning processing and/or to apply post-treatment, e.g., enhanced rinsing, after the main conditioning process, to improve the conditioning process.

Figure 10A:
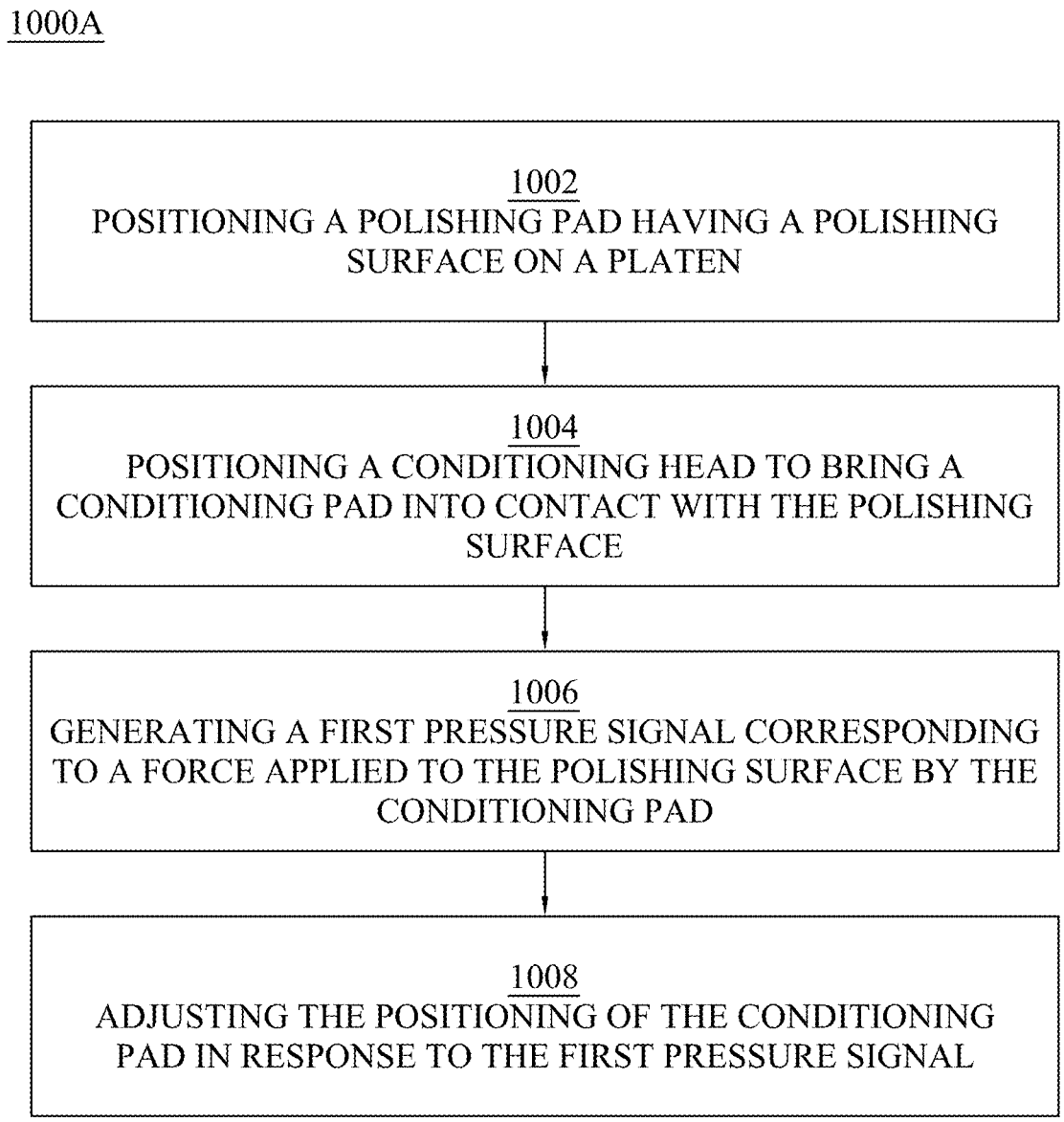
FIGS. 10A-E are process flows in accordance with some embodiments of the present disclosure.

FIG. 10A illustrates an embodiment of a polishing pad conditioning process 1000A including positioning a polishing pad having a polishing surface on a platen 1002, positioning a conditioning head to bring a conditioning pad into contact with the polishing surface 1004, generating a first pressure signal corresponding to a force applied to the polishing surface by the conditioning pad 1006 and adjusting the positioning of the conditioning pad in response to the first pressure signal 1008.

Figure 10B:
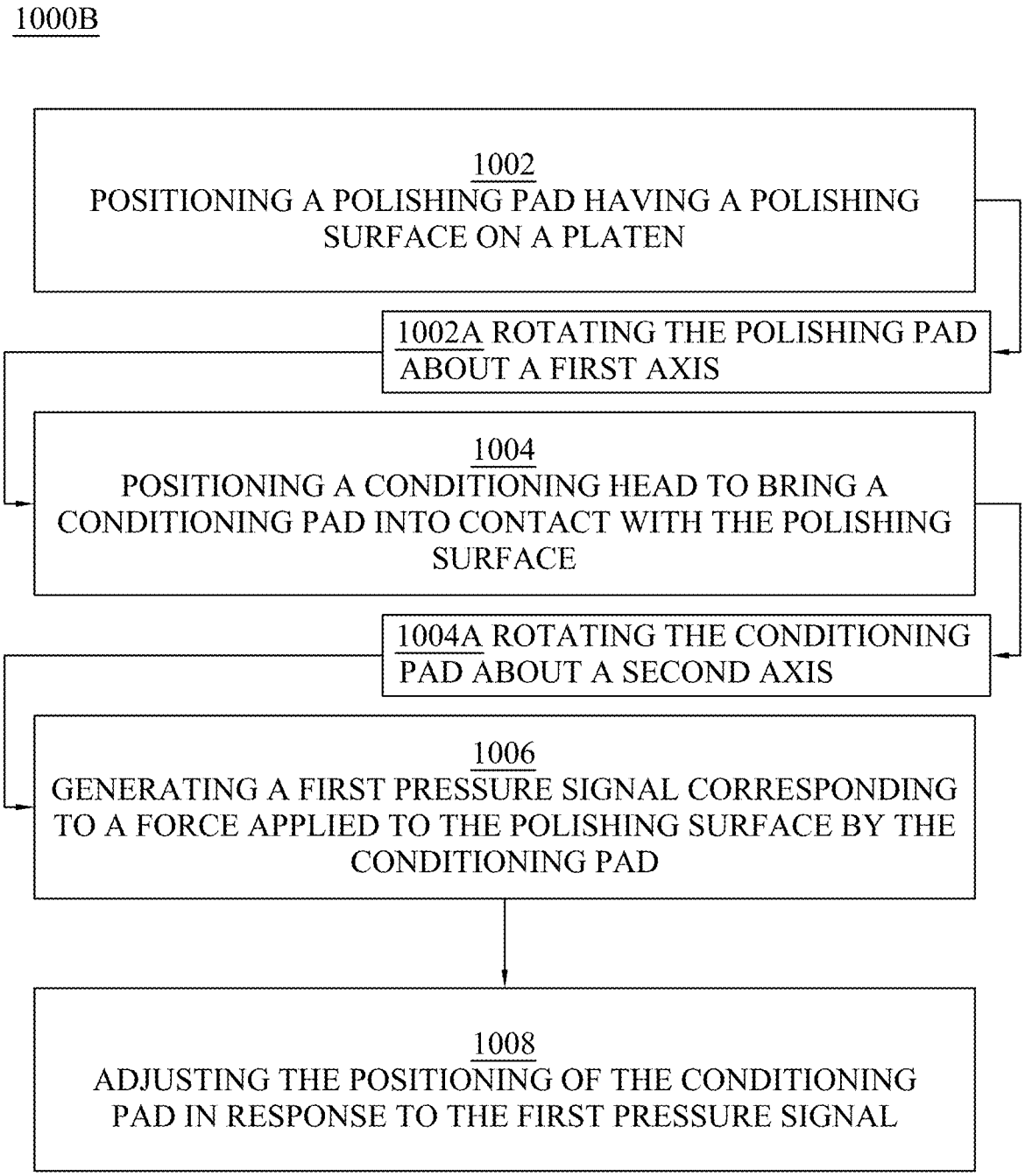

FIG. 10B illustrates an embodiment of a polishing pad conditioning process 1000B, the pad conditioning process further including rotating the polishing pad about a first axis 1002A and rotating the conditioning pad about a second axis 1004A.

Figure 10C:
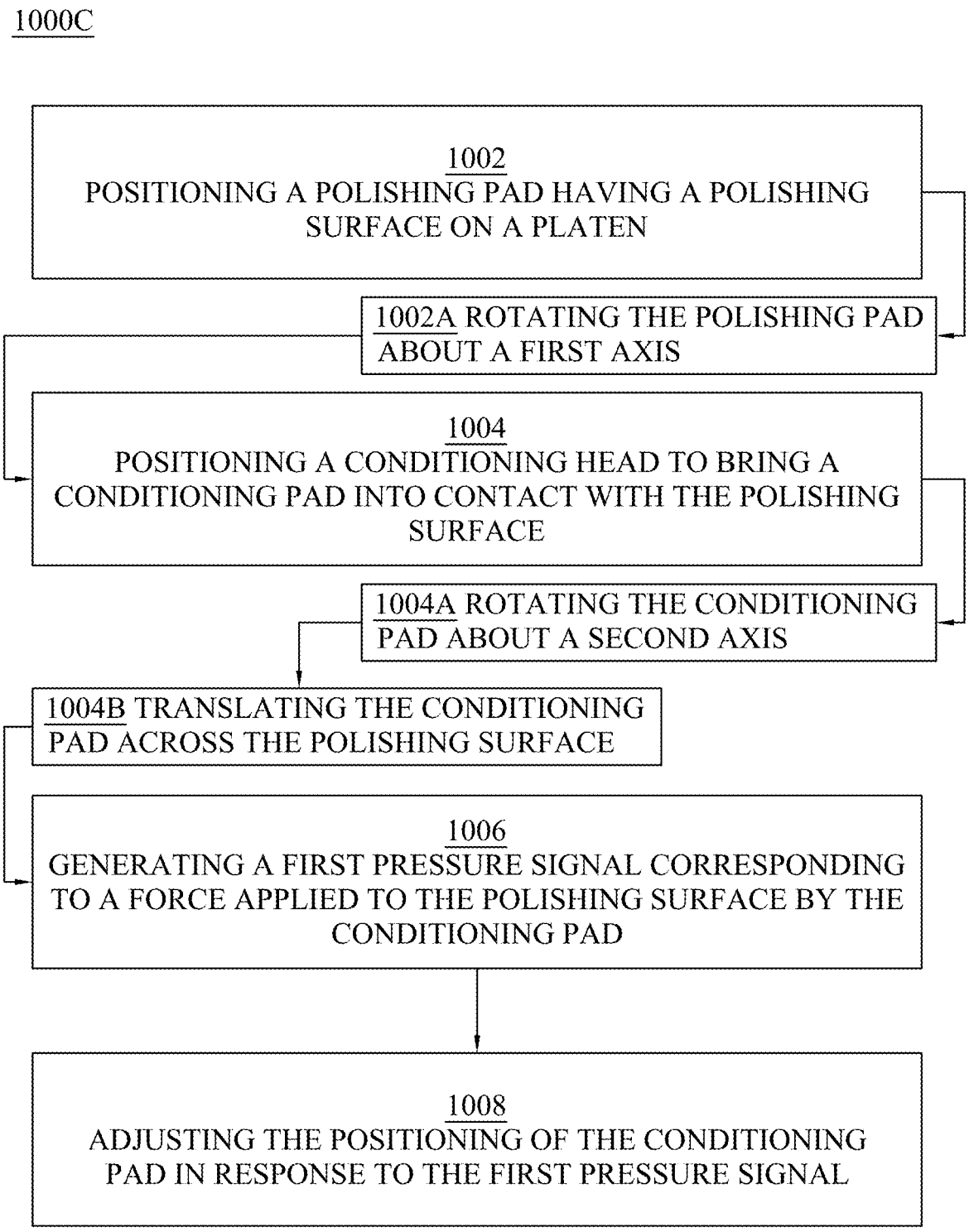

FIG. 10C illustrates an embodiment of a polishing pad conditioning process 1000C, the pad conditioning process further including translating the conditioning pad across the polishing surface 1004B.

Figure 10D:
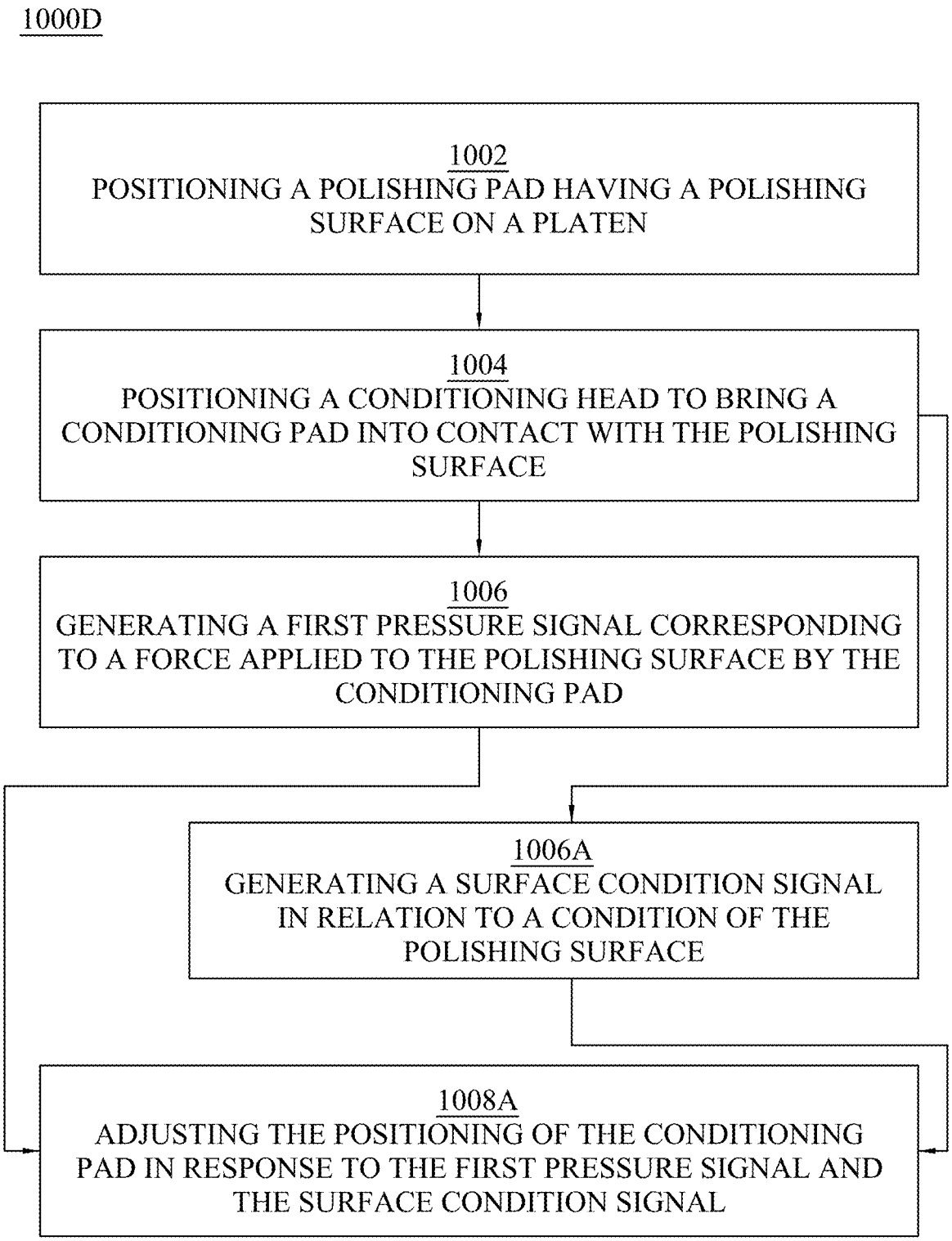

FIG. 10D illustrates an embodiment of a polishing pad conditioning process 1000D, the pad conditioning process further including generating a surface condition signal in relation to a condition of the polishing surface 1006A and adjusting the positioning of the conditioning pad in response to the first pressure signal and the surface condition signal 1008A.

Figure 10E:
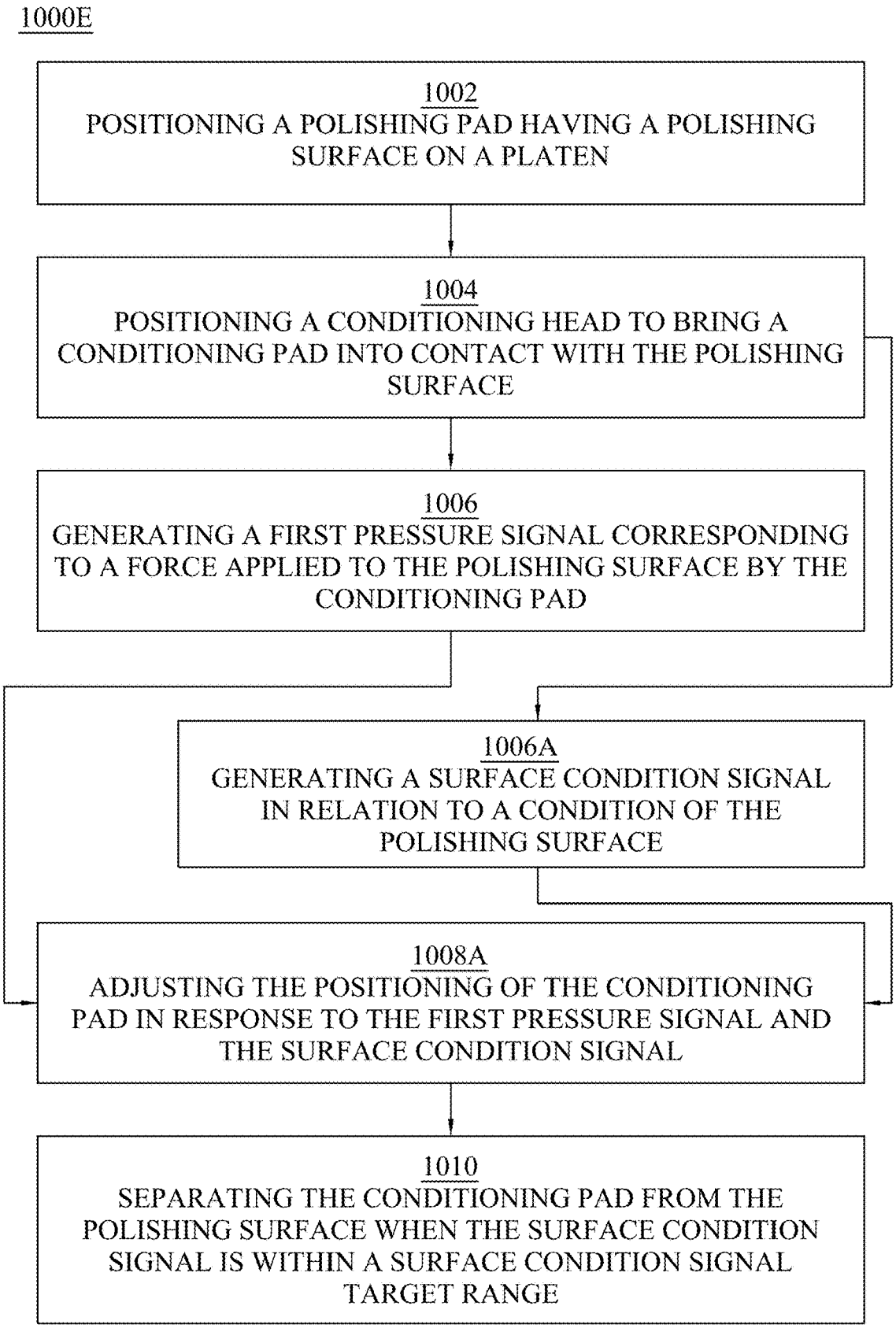

FIG. 10E illustrates an embodiment of a polishing pad conditioning process 1000E, the pad conditioning process further including generating a surface condition signal in relation to a condition of the polishing surface 1006A, adjusting the positioning of the conditioning pad in response to the first pressure signal and the surface condition signal 1008A, and separating the conditioning pad from the polishing surface when the surface condition signal is within a surface condition signal target range 1010.

Figure 11:
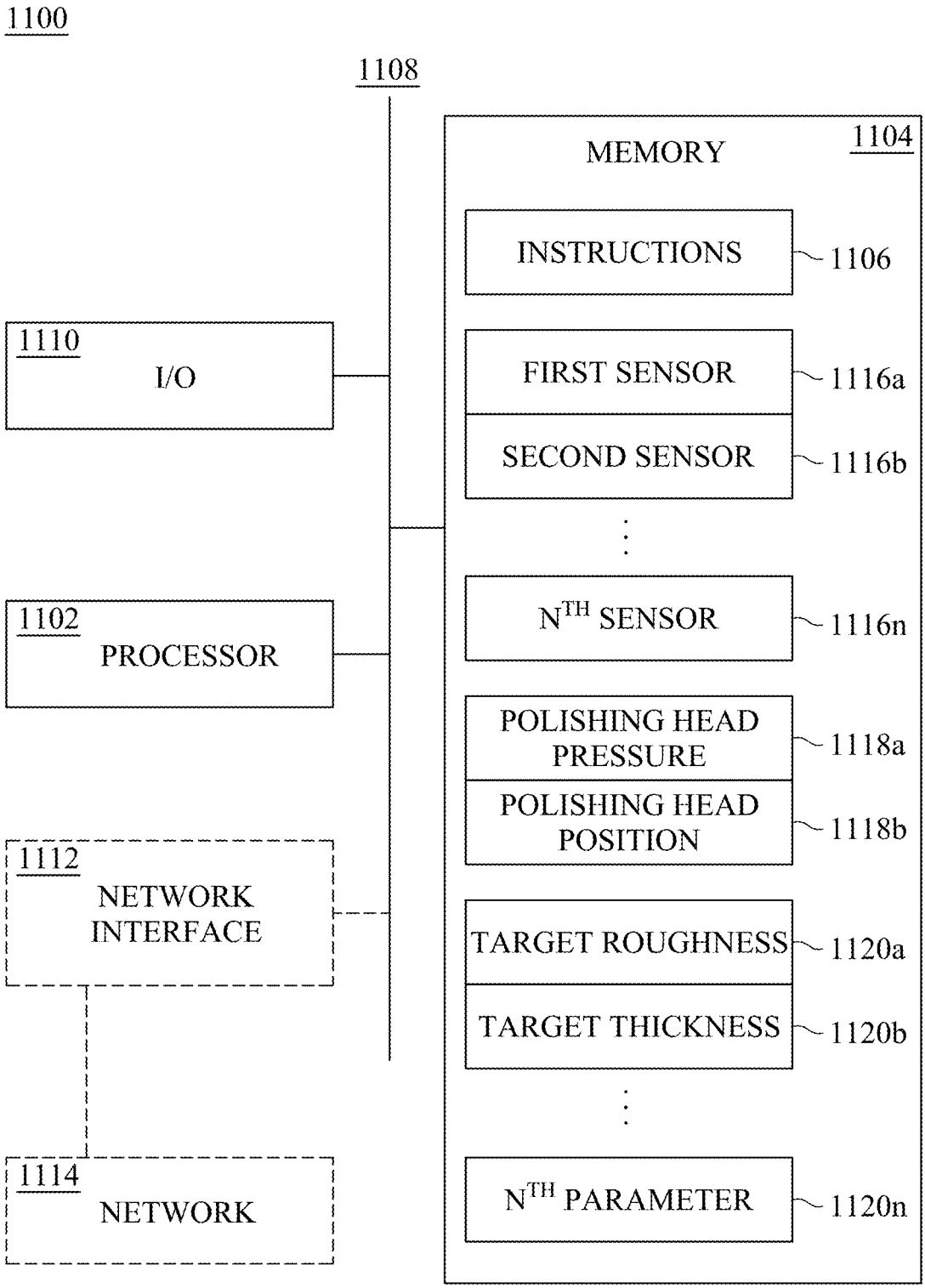
FIG. 11 is a block diagram of a general purpose computing device for implementing the controller of the polishing pad conditioning system shown in FIG. 9 and the methods shown in FIGS. 10A-E in accordance with one or more embodiments.

FIG. 11 is a schematic view of a system 1100 for conducting conditioning operations on polishing pads used in CMP processes. The system 1110 is a computing device for implementing the controller in the polishing pad conditioning system shown in FIG. 9 and for adjusting the positioning of the conditioning pad in the methods shown in FIGS. 10A-E in accordance with one or more embodiments. System 1100 includes a hardware processor 1102 and a non-transitory, computer readable storage medium 1104 encoded with, i.e., storing, the computer program code 1106, i.e., a set of executable instructions. The computer code 1106 also encodes instructions for interfacing with the manufacturing machines for producing the conditioning polishing pad. Processor 1102 is electrically coupled to the computer readable storage medium 1104 via a bus 1108. Processor 1102 is also electrically coupled to an I/O interface 1110 by bus 1108.

In some embodiments, an optional network interface 1112 (shown in dashed lines) is also electrically connected to both the processor 1102, via bus 1108, and an optional network 1114 (shown in dashed lines), so that processor 1102 and computer readable storage medium 1104 are capable of connecting to external elements via optional network 1114. The processor 1102 is configured to execute the computer program code 1106 encoded in the computer readable storage medium 1104 in order to cause system 1100 to be usable for controlling the CMP apparatus, the conditioning apparatus or performing a portion or all of the operations as illustrated in methods 1000A-E.

In some embodiments, processor 1102 is a central processing unit (CPU), a multi-processor, a distributed processing system, an application specific integrated circuit (ASIC), and/or a suitable processing unit.

In some embodiments, the computer readable storage medium 1104 is an electronic, magnetic, optical, electromagnetic, infrared, and/or a semiconductor system (or apparatus or device). For example, the computer readable storage medium 1104 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 1104 includes a compact disk-read only memory (CD-ROM), a compact disk-read/write (CD-R/W), and/or a digital video disc (DVD).

In some embodiments, the storage medium 1104 stores the computer program code 1106 configured to cause system 1100 to perform at least one of methods 1000A-E. In some embodiments, the storage medium 1104 also stores information needed for performing a method 1000A-E as well as information generated during performance of the method 1000A-E, such as first sensor data, 1116*a*, second sensor data 1116*b*, $n^{th}$ sensor data 1116*n*, polishing head pressure 1118*a*, polishing head position 1118*b*. In some embodiments, the storage medium 1104 also stores information needed for evaluating progress of the conditioning process such as target thickness 1120*a*, target surface roughness 1120*b*, or $n^{th}$ operating parameter target, 1120*n*, and/or a set of executable instructions for performing the conditioning processes of methods 1000A-E.

System 1100 includes I/O interface 1110. I/O interface 1110 is coupled to external circuitry. In some embodiments, I/O interface 1110 includes a keyboard, keypad, mouse, trackball, trackpad, and/or cursor direction keys for communicating information and commands to processor 1102.

System 1100 also includes network interface 1112 coupled to the processor 1102. Network interface 1112 allows system 1100 to communicate with network 1114, to which one or more other computer systems are connected. Network interface 1112 includes wireless network interfaces such as BLUETOOTH, WIFE WIMAX, GPRS, or WCDMA; or wired network interface such as ETHERNET, USB, or IEEE-1394. In some embodiments, one of methods 1000A-E is implemented in two or more systems 1100, and information such as parametric data, pressure sensor data, surface condition data, and conditioning head operating data are exchanged between different systems 1100 via network 1114.

During operation, processor 1102 executes a set of instructions to determine the parameters for the conditioning operation and for collecting operational information from one or more pressure sensors and, in some embodiments, other sensors providing information regarding the condition of the polishing pad and/or operation of the conditioning head. In some embodiments, the processor 1102 uses the operational data for adjusting the position of the conditioning pad relative to the polishing pad throughout the conditioning process and/or for determining that the conditioning process has been completed.

The incorporation of one or more pressure sensors within the conditioning head of a CMP apparatus, when coupled with a controller for adjusting the conditioning pad position and/or pressure applied within the conditioning head in response to the monitored pressure data, provides improved control over polishing pad conditioning processes. The availability of additional data regarding pad parameters including, for example, surface roughness (Ra), polishing pad rotation speed (RPM), conditioning pad rotation speed (RPM), groove depth, polishing pad uniformity, and/or pre-conditioning production performance allows the controller to refine the conditioning processes even further. The enhanced control of the conditioning process allows for differential conditioning on targeted regions of the polishing pad and/or the use of multi-step conditioning processes for enhancing the results of the conditioning processes.

An aspect of this description relates to a method of conditioning a polishing pad. The method includes positioning a polishing pad on a platen, the polishing pad having a polishing surface. The method further includes positioning a conditioning head to bring a conditioning pad into contact with the polishing surface. The method further includes generating a first pressure signal from a first pressure sensor, the first pressure signal is based on a force being applied to the polishing surface by the conditioning pad. The method further includes adjusting the positioning of the conditioning pad in response to evaluating the first pressure signal. In some embodiments, the method further includes rotating the polishing pad about a first axis; and rotating the conditioning pad about a second axis, the first axis and second axis being parallel. In some embodiments, the method further includes translating the conditioning pad across the polishing surface. In some embodiments, the method further includes generating a surface condition signal in relation to a condition of the polishing surface; and adjusting the vertical position of the conditioning pad responsive to the first pressure signal and the surface condition signal. In some embodiments, the method further includes evaluating the surface condition signal against a surface condition signal target range; and positioning the conditioning head to separate the conditioning pad from the polishing surface when the surface condition signal is within the surface condition signal target range.

An aspect of this description relates to a method of conditioning a polishing pad. The method includes positioning a conditioning head to bring a conditioning pad into contact with a polishing surface of a polishing pad. The method further includes generating a first pressure signal using a first pressure sensor based on a force being applied to the polishing surface by the conditioning pad. The method further includes generating a surface condition signal using an optical scanner. The method further includes adjusting the positioning of the conditioning pad in response to at least one of the first pressure signal or the surface condition signal. In some embodiments, adjusting the position of the conditioning pad includes adjusting the conditioning pad in response to both the first pressure signal and the surface condition signal. In some embodiments, the method further includes rotating the conditioning pad about a first axis; and rotating the polishing pad about a second axis, wherein the first axis is offset from the second axis. In some embodiments, the method further includes separating the conditioning pad from the polishing pad in response to the surface condition signal indicating a surface condition within a target range. In some embodiments, the method further includes translating the conditioning pad across the polishing surface. In some embodiments, translating the conditioning pad includes translating the conditioning pad in an arcuate direction. In some embodiments, translating the conditioning pad includes translating the conditioning pad in a radial direction. In some embodiments, generating the surface condition signal includes detecting a surface condition of the polishing pad at a location separated from the conditioning pad. In some embodiments, the method further includes dispensing a solution onto the polishing pad during rotation of the conditioning pad relative to the polishing pad.

An aspect of this description relates to a method of conditioning a polishing pad. The method includes positioning a conditioning head to bring a conditioning pad into contact with a polishing surface of a polishing pad. The method further includes rotating the conditioning pad relative to the polishing pad. The method further includes generating a pressure signal using a plurality of pressure sensors based on a force being applied to the polishing surface by the conditioning pad during rotation of the conditioning pad. The method further includes adjusting the positioning of the conditioning pad in response to the pressure signal. In some embodiments, generating the pressure signal includes determining a distribution of force applied across the conditioning pad. In some embodiments, the method further includes generating a surface condition signal using an optical scanner. In some embodiments, adjusting the positioning of the conditioning pad includes adjusting the conditioning pad in response to the surface condition signal. In some embodiments, the method further includes separating the conditioning pad from the polishing pad in response to the surface condition signal indicating a surface condition within a target range. In some embodiments, the method further includes dispensing a solution onto the polishing pad during rotation of the conditioning pad.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method of conditioning a polishing pad comprising:

positioning the polishing pad on a platen, the polishing pad having a polishing surface;

positioning a conditioning head to bring a conditioning pad into contact with the polishing surface;

generating a first pressure signal from a first pressure sensor, the first pressure signal is based on a force being applied to the polishing surface by the conditioning pad;

adjusting the positioning of the conditioning pad in response to evaluating the first pressure signal;

generating a surface condition signal, based on a signal from a surface condition sensor, in relation to a condition of the polishing surface;

removing debris from the polishing pad using a liquid from a flush solution dispenser mounted directly adjacent to the surface condition sensor; and adjusting a vertical position of the conditioning pad responsive to the first pressure signal and the surface condition signal, wherein adjusting the vertical position of the conditioning pad comprises adjusting a vertical position of the surface condition sensor.

2. The method of conditioning the polishing pad according to claim 1, further comprising:

rotating the polishing pad about a first axis; and rotating the conditioning pad about a second axis, the first axis and second axis being parallel.

3. The method of conditioning the polishing pad according to claim 2, further comprising:

translating the conditioning pad across the polishing surface.

4. The method of conditioning the polishing pad according to claim 1, wherein positioning the conditioning head comprises positioning the conditioning head using a support arm, and adjusting the positioning of the conditioning pad comprises adjusting the positioning of the conditioning pad relative to the support arm.

5. The method of conditioning the polishing pad according to claim 4, further comprising:

evaluating the surface condition signal against a surface condition signal target range; and positioning the conditioning head to separate the conditioning pad from the polishing surface when the surface condition signal is within the surface condition signal target range.

6. A method of conditioning a polishing pad comprising:

positioning a conditioning head to bring a conditioning pad into contact with a polishing surface of the polishing pad;

generating a first pressure signal using a first pressure sensor based on a force being applied to the polishing surface by the conditioning pad;

generating a surface condition signal using an optical scanner;

removing debris from the polishing pad using a liquid from a flush solution dispenser mounted directly adjacent to the optical scanner; and adjusting the positioning of the conditioning pad in response to the first pressure signal and the surface condition signal, wherein adjusting the positioning of the conditioning pad comprises adjusting positioning of the optical scanner.

7. The method of claim 6, wherein adjusting the position of the conditioning pad comprises adjusting the positioning of the conditioning pad and adjusting the positioning of the optical scanner using a support arm.

8. The method of claim 6, further comprising:

rotating the conditioning pad about a first axis; and rotating the polishing pad about a second axis, wherein the first axis is offset from the second axis.

9. The method of claim 6, further comprising separating the conditioning pad from the polishing pad in response to the surface condition signal indicating a surface condition within a target range.

10. The method of claim 6, further comprising translating the conditioning pad across the polishing surface.

11. The method of claim 10, wherein translating the conditioning pad comprises translating the conditioning pad in an arcuate direction.

12. The method of claim 10, wherein translating the conditioning pad comprises translating the conditioning pad in a radial direction.

13. The method of claim 6, wherein generating the surface condition signal comprises detecting a surface condition of the polishing pad at a location separated from the conditioning pad.

14. The method of claim 6, further comprising dispensing a solution onto the polishing pad during rotation of the conditioning pad relative to the polishing pad.

15. A method of conditioning a polishing pad comprising:

positioning, using a support arm, a conditioning head to bring a conditioning pad into contact with a polishing surface of the polishing pad;

rotating the conditioning pad relative to the polishing pad;

determining a surface condition of the polishing pad using a surface condition sensor;

generating a pressure signal using a plurality of pressure sensors based on a force being applied to the polishing surface by the conditioning pad during the rotation of the conditioning pad, wherein the plurality of pressure sensors is between the support arm and the conditioning pad;

removing debris from the polishing pad using a liquid from a flush solution dispenser mounted directly adjacent to the surface condition sensor;

adjusting the positioning of the conditioning pad with respect to the support arm in response to the pressure signal; and adjusting the positioning of the conditioning pad and the surface condition sensor using the support arm during a polishing process.

16. The method of claim 15, wherein generating the pressure signal comprises determining a distribution of force applied across the conditioning pad.

17. The method of claim 15, wherein determining the surface condition comprises determining the surface condition using the surface condition sensor, wherein the surface condition sensor comprises an optical scanner.

18. The method of claim 17, wherein adjusting the positioning of the conditioning pad comprises adjusting the conditioning pad in response to a surface condition signal.

19. The method of claim 17, further comprising separating the conditioning pad from the polishing pad in response to a surface condition signal indicating the surface condition is within a target range.

20. The method of claim 15, further comprising dispensing a solution onto the polishing pad during rotation of the conditioning pad.

* * * * *